US009827468B2

(12) United States Patent
Orr

(10) Patent No.: US 9,827,468 B2
(45) Date of Patent: Nov. 28, 2017

(54) ANCHOR FITTING FOR HOLLOW BALL

(71) Applicant: Limpet Sports Management B.V., Bussum (NL)

(72) Inventor: Moshe Orr, London (GB)

(73) Assignee: Limpet Sports Management B.V., Bussum (NL)

( * ) Notice: Subject to any disclaimer, the term of this patent is extended or adjusted under 35 U.S.C. 154(b) by 0 days.

(21) Appl. No.: 15/028,053

(22) PCT Filed: Aug. 28, 2014

(86) PCT No.: PCT/IB2014/064109

§ 371 (c)(1),
(2) Date: Apr. 8, 2016

(87) PCT Pub. No.: WO2015/056115

PCT Pub. Date: Apr. 23, 2015

(65) Prior Publication Data

US 2016/0236044 A1 Aug. 18, 2016

(30) Foreign Application Priority Data

Oct. 14, 2013 (ZA) ..... 2013/07637

(51) Int. Cl.
*A63B 43/00* (2006.01)
*A63B 39/00* (2006.01)
(Continued)

(52) U.S. Cl.
CPC ..... *A63B 43/007* (2013.01); *A63B 39/00* (2013.01); *A63B 2102/02* (2015.10); *A63B 2102/04* (2015.10); *A63B 2102/18* (2015.10)

(58) Field of Classification Search
CPC ..... A63B 2102/02; A63B 2102/18; A63B 2102/04
See application file for complete search history.

(56) References Cited

U.S. PATENT DOCUMENTS 3,729,195 A 4/1973 Hutt et al.
3,764,140 A * 10/1973 Lotfy ..... A63B 69/0079 473/474

(Continued)

FOREIGN PATENT DOCUMENTS

CN 201020228 Y 2/2008
WO WO-03/041813 A1 5/2003

OTHER PUBLICATIONS

International Search Report and Written Opinion, International Application No. PCT/IB2014/064109, dated Dec. 10, 2014.

*Primary Examiner* — Steven Wong
(74) *Attorney, Agent, or Firm* — Marshall, Gerstein & Borun LLP

(57) ABSTRACT

An improved anchor fitting (10) for anchoring a tether cord (22) to a hollow ball (12). The anchor fitting (10) includes an anchor body (16) comprising a shank portion (18) and a head (20) at one end of the shank portion. The anchor body is received in a hole (14) in the wall of the ball and defines an axial passage through which the tether cord extends. The anchor fitting includes two rigid shoulder-defining bodies (26) and (28) which are located within the ball and which extend perpendicularly relative to one another when assembled. The shoulder-defining bodies define holes in which the shank portion of the anchor body is received, with the head (20) abutting an inner side of the shoulder-defining body (28). A flexible resilient rubber washer (34) is located between the shoulder-defining bodies and an interior side of the wall for absorption of impact forces acting on the wall of the ball when the ball is struck by a bat.

20 Claims, 11 Drawing Sheets

(51) Int. Cl.

| | |
|---|---|
| *A63B 102/02* | (2015.01) |
| *A63B 102/04* | (2015.01) |
| *A63B 102/18* | (2015.01) |

(56) References Cited

U.S. PATENT DOCUMENTS

| | | | | |
|---|---|---|---|---|
| 3,829,093 | A * | 8/1974 | Abrams | A63B 21/1627 473/575 |
| 4,162,790 | A | 7/1979 | Kelsey | |
| 4,248,423 | A | 2/1981 | Lotfy | |
| 4,272,076 | A * | 6/1981 | Song | A63B 43/007 473/575 |
| 7,252,607 | B2 | 8/2007 | Gormley | |
| 2003/0092516 | A1* | 5/2003 | Gormley | A63B 43/007 473/613 |
| 2004/0204299 | A1* | 10/2004 | Shirley | A63B 24/0021 482/81 |
| 2006/0052188 | A1* | 3/2006 | Gormley | A63B 43/007 473/575 |
| 2014/0329626 | A1* | 11/2014 | Orr | A63B 43/007 473/614 |
| 2016/0236045 | A1* | 8/2016 | Sharp | A63B 69/0079 |

* cited by examiner

ANCHOR FITTING FOR HOLLOW BALL

FIELD OF INVENTION

This invention relates to a ball for use in bat and ball games wherein the ball has a flight control device for controlling the orientation of the ball in flight, such as a tether cord which is attached to the ball enabling the ball to be used in tethered tennis-type ball games or a tail comprising one or more streamers attached to the ball, when used in tennis or badminton-type untethered ball games.

This invention relates particularly to an improved anchor fitting for attaching a flight control device to a hollow ball, such as a tether cord to a hollow ball for use in tethered ball games or a tail to a hollow ball when used in tennis or badminton-type untethered ball games.

BACKGROUND TO INVENTION

In the context of this specification, a "tethered ball" is a ball for use in tethered bat and ball games, having a tether cord attached thereto which is in turn attached to an anchor point at a location remote from the ball and around which the ball is struck.

Any reference hereinafter after to a hollow ball must be interpreted as a reference to a hollow ball having a wall of resiliently deformable rubber, or like, material forming the ball, the wall having a hole formed therein for enabling anchoring of a flight control device such as a tether cord or a tail, to the ball. The hole, where convenient, shall merely be referred to hereinafter as the hole in the ball.

It is known in relation to tethered bat and ball games, that the ball has a tether cord anchored thereto. In order to provide for anchoring of the tether cord to a hollow ball, an anchor is provided by a relatively large, substantially rigid anchor formation that is displaced through a hole provided therefor in the wall forming the ball, into the interior of the ball, the anchor formation then having the tether cord engaged therewith for effective anchoring of the tether cord with respect to the ball. It will be understood that because the wall forming the ball generally is of a resiliently deformable rubber material, the anchor formation must be significantly larger than the hole provided therefor in the wall, for ensuring that the anchor formation remains secure within the ball and is not pulled through the hole in the ball when playing a tethered ball game with the ball.

The design of anchor fittings for fitting a tether cord to a hollow ball for use in tethered bat and ball games or a tail for use in untethered bat and ball games, has always presented a technical challenge in view of the stresses imposed on an anchor fitting when the ball is struck. This problem is particularly evident in the design of anchor fittings for fitting a tether cord to a hollow ball for use in tethered bat and ball games such as tether tennis games, in which the ball is subjected to particularly high stresses when struck by a bat against the holding force exerted by the tether cord on the ball. In the case of tether tennis games it was only when an effective anchor fitting was developed which could absorb the bat impact forces without causing the tethered tennis ball to rapidly split open after only a few blows, was it possible to mass market games of this type which have since proved to be popular in a number of markets for many years. One such anchor fitting which has been used with a degree of success for anchoring a tether cord to a hollow ball is the anchor fitting disclosed in U.S. Pat. No. 7,252,607 in the name of European Sports Merchandising B.V. The anchor fitting disclosed in U.S. Pat. No. 7,252,607 includes a pair of rigid shoulder-defining bodies and an elongate anchor body which holds the shoulder-defining bodies in place within the ball and extends through the ball hole in the assembled condition, thereby protecting the ball hole wall from being damaged by the tether cord during play. The provision of relatively small separate components which can be inserted separately into the ball through the ball hole made it considerably easier to insert the components into the ball and also considerably reduced the risk of accidentally damaging the wall of the ball defining the hole. Although the anchor fitting disclosed in U.S. Pat. No. 7,252,607 has been used with a certain degree of success, a problem has arisen with the use of anchor fittings of this type in that a tendency of the anchor fitting to be pulled from the ball through the hole defined therein, when the ball is subjected to a particularly high impact blow, has been observed. This problem is considerably exacerbated in the case of relatively thin walled hollow rubber balls used in tether tennis games. Such lighter thin-walled balls are desirable for a number of reasons for use in tethered ball games as they enable the use of lighter bats and also offer an improved impact feel when struck by a bat. Attempts by the applicant to use any of the known anchor fittings, including the anchor fitting disclosed in U.S. Pat. No. 7,252,607, did not work with balls having a wall thickness of less than 3.5 mm (which is the approximate wall thickness of a standard tennis ball) as the balls soon split in the area surrounding the hole when struck by a heavy blow with a bat.

Further in the context of this specification, a "streamer ball" is a ball for use in tennis or badminton type ball games, of a type having a tail comprising a number of elongate flexible streamers which are attached to the ball for stabilizing the flight orientation of the ball. Streamer balls of this type are known.

A streamer ball of this type is disclosed in International Patent Application PCT/IB02/04673 (Gormley). The streamer ball comprises a ball and a tail having an elongate flexible spacer stem and a number of streamers that are spaced from the ball by the spacer stem. The use of a tail connected to a ball has a number of benefits when playing a tennis-type ball game. Firstly, the provision of a tail, reduces any tendency of the ball to spin or swerve during flight thereby causing the ball to follow a regular flight path. Secondly, the use of a tail which trails behind the ball in flight creates drag which slows the ball down so that when the ball is struck with a bat, the distance that the ball can travel is effectively reduced, thereby permitting a tennis-type ball game to be played in a relatively small area while the ball can still be struck at "full strength". Thirdly, the tail significantly reduces roll of the ball on a ground surface, thereby facilitating easy ball recovery.

A further problem which has become apparent with regard to the use of anchor fittings having at least one rigid shoulder-defining body, is that distal ends of the shoulder-defining body exert a relatively high point load on the interior side of the wall forming the ball, when the ball is struck. The point loading at the distal ends of the shoulder-defining body is even greater if the ball is struck, in a region of the ball wherein the wall forming the ball abuts a distal end of the shoulder-defining body resulting not only in damage to the wall forming the ball at the region of impact with the distal end of the shoulder-defining body, but also to an unpleasant jarring impact feel.

It is thus an object of the present invention to ameliorate the abovementioned problems associated with existing known anchor fittings.

SUMMARY OF INVENTION

According to the invention there is provided an improved anchor fitting for anchoring a flight control device to a hollow ball which includes, in an operative configuration with respect to the ball, an anchor body of a substantially rigid material which is attached to the flight control device and which defines an elongate shank portion operatively extending through a hole in the ball;

at least one substantially rigid shoulder-defining body which is located within the ball and which extends radially outwardly with respect to the anchor body; and at least one resiliently deformable impact absorption formation located between the shoulder-defining body and an interior side of a wall forming the ball.

The shoulder-defining body may define a curved abutment segment that is complementary to and that abuts an inner side of the impact absorption formation in the operative configuration of the anchor fitting.

In an embodiment of the invention, the shoulder-defining body may define a hole therethrough which is operatively positioned in register with the hole in the ball, the shank portion of the anchor body operatively extending through the holes in the shoulder-defining body and the ball and defining an enlarged head which bears against a side of the shoulder-defining body remote from the side thereof which abuts the impact absorption formation, thereby holding the shoulder-defining body against the impact absorption formation.

The impact absorption formation may be in the form of a resilient washer which, in the operative configuration of the improved anchor fitting with respect to the ball, is located between the shoulder-defining body and an interior side of the wall forming the ball, the resilient washer defining a central hole which is operatively in register with the hole in the ball and the hole in the shoulder-defining body, the resilient washer projecting beyond distal ends of the shoulder-defining body.

The resilient washer may have a curved configuration that is complementary to a curved interior side of the wall forming the ball. More specifically, the resilient washer may have a circumferential skirt which circumscribes and covers a distal end region of the shoulder-defining body in an assembled condition of the anchor fitting within a ball.

In a particular embodiment of the invention, the improved anchor fitting may include a single shoulder-defining body which is disc-shaped when viewed in plan view. As such, the resilient washer may have a complementary disc-shaped configuration when viewed in plan view.

The Applicant envisages further that in an alternative embodiment, the shoulder-defining body may be formed integrally with the anchor body so as to form a combined anchor body and shoulder-defining body having a unitary structure.

In another embodiment of the invention, the improved anchor fitting may include a single shoulder-defining body having an elongate configuration. As such, the improved anchor fitting may include a pair of impact absorption formations wherein each impact absorption formation is in the form of a resilient pad wherein each pad is connected to a different distal end region of the shoulder-defining body so as to be located between the interior side of the wall forming the ball and the distal end region of the shoulder-defining body in an arrangement where each pad extends beyond the distal end of the associated shoulder-defining body. More specifically, each impact absorption formation may comprise a locating body defining one of the resilient pads, the locating body further defining a socket within which an end region of the shoulder-defining body is received. In a particular embodiment, the locating body may be moulded to one of the distal end regions of the shoulder-defining body.

In yet another embodiment of the invention, the improved anchor fitting may include two of elongate shoulder-defining bodies which each have an elongate configuration and which, when operatively positioned with their respective holes in register with the hole in the ball, extend substantially perpendicularly with respect to one another. As such, the improved anchor fitting may include four impact absorption formations in the form of resilient pads wherein each pad is connected to a different end region of the shoulder-defining bodies so as to be located between the interior side of the wall forming the ball and the distal end region of the shoulder-defining body associated therewith, in an arrangement wherein each pad extends beyond the distal end of the associated shoulder-defining body. The shoulder-defining bodies may define complementary locating formations that serve to locate the shoulder-defining bodies with respect to one another during assembly of the anchor fitting with the aid of the tether cord.

In a further embodiment of an anchor fitting in accordance with the invention, the two shoulder-defining bodies may together define a circular peripheral edge profile when viewed in plan view, in an assembled condition of the anchor fitting within a ball. The impact absorption formation of the anchor fitting may be in the form of a resilient washer which, in the operative configuration of the improved anchor fitting with respect to the ball, is located between the shoulder defining bodies and an interior side of the wall forming the ball in an assembled condition of the anchor fitting within the ball, the resilient washer defining a central hole which is operatively in register with the hole in the ball and the holes in the shoulder-defining bodies, the resilient washer projecting beyond distal ends of the shoulder-defining bodies.

The improved anchor fitting may be configured for anchoring a flight control device in the form of a tether cord to the ball. More specifically, the anchor body may define an axial passage therethrough which extends through the elongate shank portion and the head, the axial passage permitting a tether cord having a stop formation at an end of the cord within the ball, to extend therethrough into the ball, the improved anchor fitting including a bearing body operatively located between the stop formation at the end of the tether cord and the head of anchor body, to operatively bear against the head of the anchor body and rotate relative to the head, in use, thereby to permit free rotation of the tether cord within the axial passage defined through the elongate shank portion and the head of the anchor body.

In another embodiment, the improved anchor fitting may be configured for anchoring a flight control device in the form of a tail to the ball. More specifically, the tail may comprise a spacer stem having a proximal end which is integrally formed with the anchor body of the improved anchor fitting and a distal end and at least one flexible streamer which is attached to the distal end of the spacer stem.

The invention extends to a ball including the anchor fitting as defined and described hereinabove as part thereof.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
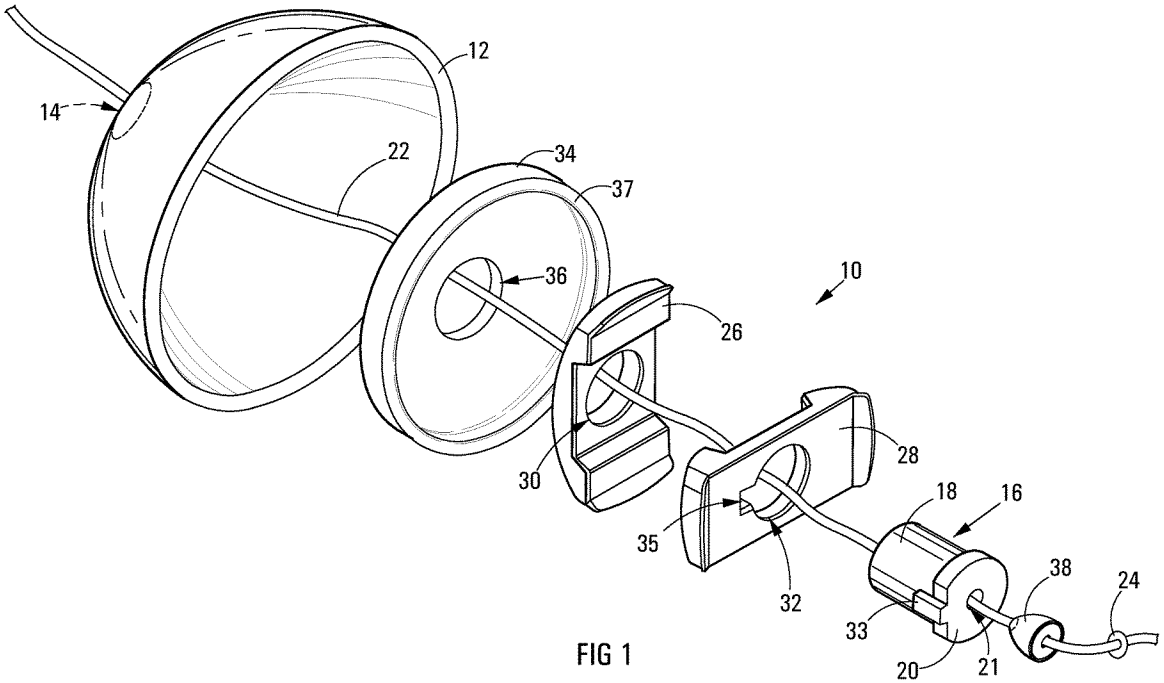
FIG. 1 shows a fragmentary exploded three-dimensional view of a first embodiment of an improved anchor fitting in accordance with the invention, for anchoring a flight control device in the form of a tether cord, to a ball.
Figure 2:
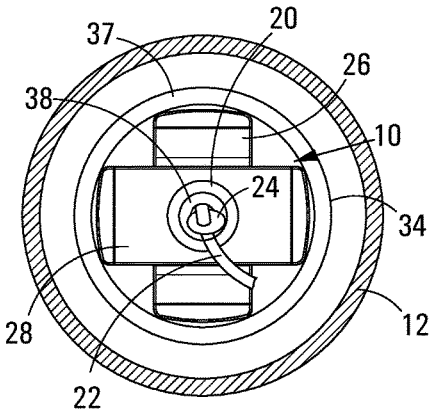
FIG. 2 shows a sectional rear end view of the anchor fitting as shown in FIG. 1 fitted to a ball.

With reference to FIGS. 1 to 5 of the drawings, a first embodiment of an improved anchor fitting for anchoring a flight control device in the form of a tether cord to a hollow ball, in accordance with the invention, is designated generally by the reference numeral 10. The anchor fitting 10 is shown in a pre-assembled condition thereof in FIG. 1 of the drawings and is shown in its assembled operative configuration in FIGS. 2, 3 and 4 of the drawings. The anchor fitting is particularly configured to enable anchoring of a tether cord to a hollow ball for use in a tethered ball game.

A ball within which anchor fitting 10 can be used is designated generally by the reference 12 and specifically is a hollow rubber ball which has a hole 14 defined in the wall forming the ball, the hole facilitating the location of the anchor fitting 10 with respect to the ball, as is described hereinafter.

The anchor fitting 10 includes an anchor body 16 which defines an elongate shank portion 18 and a head 20 at one end of the shank portion, the diameter of the head 20 being slightly larger than that of the shank portion 18. The anchor body defines an axial passage 21 which extends through the shank portion 18 and the head 20, the axial passage 21 permitting a tether cord 22 to extend therethrough into the ball 12. A stop formation in the form of a knot 24 is tied at a proximal end region of the cord 22, the purpose of which will be explained hereinbelow.

The anchor fitting 10 further includes two shoulder-defining bodies 26 and 28 which define holes 30 and 32, respectively, therethrough. The holes 30 and 32 are of equal diameter and permit the entire shank portion 18 of the anchor body 16 to fit slidably therethrough.

Figure 3:
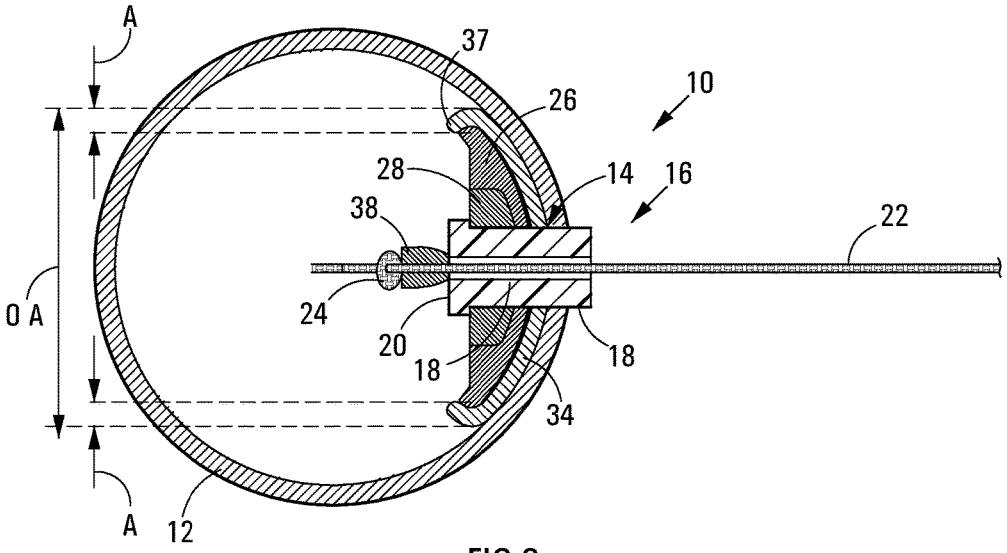
FIG. 3 shows a sectional side view of the assembled anchor fitting of FIG. 1 in its operative configuration with respect to a hollow ball.
Figure 4:
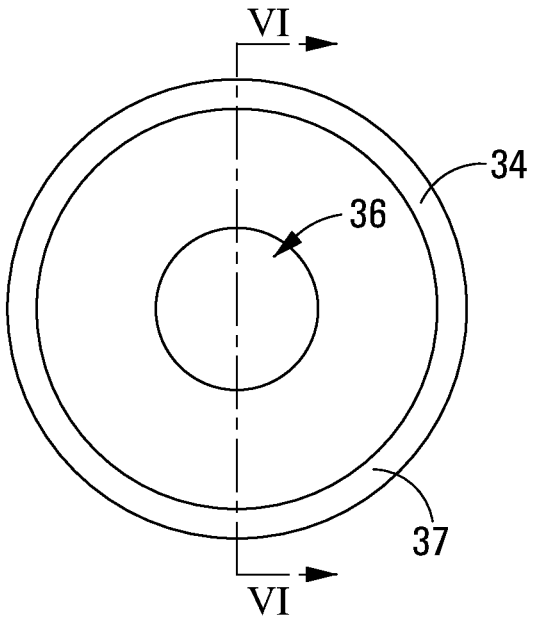
FIG. 4 shows an inner end view of the resilient washer of the anchor fitting of FIG. 1.
Figure 5:
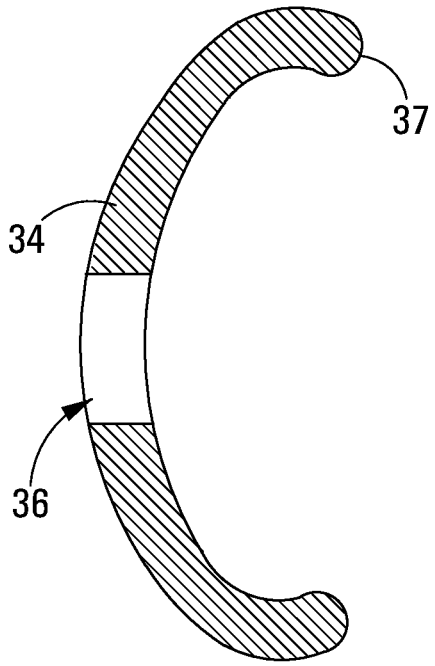
FIG. 5 shows a sectional side view of the resilient washer of FIG. 4, sectioned along section line VI-VI of FIG. 4.

Opposing faces of the shoulder-defining bodies 26 and 28 as shown particularly in FIG. 1 of the drawings, define complementary formations that provide for the location of the shoulder-defining bodies with respect to one another in a configuration in which they are disposed at right angles to one another as is shown in FIG. 3 of the drawings. The shoulder-defining bodies 26 and 28 particularly comprise bodies provided with curved surface profile segments as shown, the curved surface profile segments providing for profiled faces that are complementary to the curvature of the wall forming the ball 12.

The anchor body 16 defines a projecting abutment 33 and the shoulder-defining body 28 defines a complementary cut-out 35 in which the abutment 33 is received in the assembled configuration of the anchor fitting thereby preventing rotation of the anchor body relative to the shoulder-defining bodies.

The anchor body 16 and the shoulder-defining bodies 26 and 28 are formed of a substantially rigid material, typically a synthetic plastics material, thus ensuring that through the rigidity of the anchor fitting that is created when the anchor fitting is disposed in its operative configuration, the anchor fitting will be effectively anchored with respect to the ball.

The anchor fitting 10 also includes an impact absorption formation in the form of a flexible resilient washer 34 of rubber or other suitable resilient material, which is located between the shoulder-defining bodies 26 and 28 and an interior side of the wall 12 forming the ball. More particularly, the resilient washer 34 is located between the shoulder-defining body 26 and an interior side of the wall 12. The resilient washer 34 defines a central hole 36 which is equal in diameter to the holes 30 and 32 defined in the shoulder-defining bodies 26 and 28, respectively, and which thus permits to the shank portion 18 of the anchor body to fit to slidably therethrough. It will be appreciated that in the assembled configuration of the anchor fitting, the hole 14 will be aligned with the hole 36 of the washer 34 and the holes 30 and 32 of the shoulder-defining bodies 26 and 28 respectively, thereby permitting the portion 18 of the anchor body 16 to fit slidably therethrough. The washer has a curved configuration that is complementary to the curvature of the internal face of the wall forming the ball in the region of the hole 14. The resilient washer has a circumferential skirt 37 which extends inwardly from an annular peripheral region of the washer. The circumferential skirt 37 of the resilient washer has a thickness of at least 2 mm and circumscribes and covers the distal end regions of the shoulder-defining bodies.

The anchor fitting also includes a freely rotatable bearing body 38 located between the anchor body and the knot 24, the anchor fitting being assembled by merely pulling on the tether cord 22. When the anchor fitting is assembled, the bearing body will abut against the head 20 of the anchor body. The bearing body is preferably conical in shape and provides for free rotation of the tether cord 22 within the axial passage 21 defined within the anchor body, during play of a tethered ball game with the ball.

In order to assemble the anchor fitting with respect to the ball 12, the tether cord 22 is pulled causing the knot 24 to engage the bearing body which acts on the anchor body causing it to be displaced within the ball in a direction towards the hole 14. This causes the shoulder-defining bodies to be positioned perpendicularly relative to one another and pulled towards the interior face of the ball into a position in which the shoulder-defining bodies abut against the resilient washer 34. More specifically, the shank portion 18 of the anchor body 16 is displaced through the holes 32 and 30 in the shoulder-defining bodies 26 and 28, the hole 36 in the resilient washer 34 and the hole 14 in the ball 12 such that an end segment of the shank portion extends externally from the ball 12 through the hole 14.

It should be understood that a portion of the assembled anchor fitting which is disposed within the ball is relatively large, while the individual components of the anchor fitting are relatively small, the components being displaceable through the hole 14 of the ball relatively easily, particularly without damaging the wall forming the wall in the region of the hole 14. As such, fitting of the anchor fitting to a ball is achieved relatively simply and quickly. The cord 22 therefore simultaneously fulfils the dual function of displacing the anchor fitting into its assembled configuration and a tether cord for tethering the ball for use in a tethered ball game.

The applicant has found that the provision of the resilient washer reduces and spreads the shock load acting on the wall of the ball when the ball is struck by relatively heavy blows. The resilient washer being of rubber or a rubber-like material, acts as a shock absorber absorbing impact forces on the ball when struck. The curved configuration of the resilient washer which corresponds to the curvature of the inner face of the ball ensures that a large surface area of the resilient washer remains in contact with the ball thereby assisting in spreading shock loads applied to the ball over a relatively large surface area. Furthermore, the thickness of the resilient washer in the annular peripheral region of the washer which abuts end regions of the shoulder-defining bodies in the assembled condition of the anchor fitting, is such that the washer is effective in absorbing shock loads, while being sufficiently flexible so as to allow the resilient washer to deform as the ball deforms upon impact thereby enhancing the impact feel of the ball when struck. Furthermore, the diameter of the resilient washer is such that the resilient washer projects beyond the distal ends of the shoulder-defining bodies, thereby extending the effective surface area of the anchor fitting within the ball which bears against the interior side of the wall forming the ball, in the assembled condition of the anchor fitting thus improving resistance of the anchor fitting to being pulled from the ball through the hole 14. The increased circumferential surface area provided by the resilient washer is clearly illustrated in FIG. 3. The skirt 37 of the resilient washer which circumscribes distal ends of the shoulder-defining bodies 26 and 28, is designated by the reference letter "A", while the overall surface area presented by the washer 34 is designated "OA". It will be appreciated that when the ball 12 is struck by a bat in the region of the resilient washer, the wall of the ball will deform inwardly in this region, against the skirt 37 of the resilient washer which cushions and absorbs the impact from the blow to the ball and protects the inner side of the wall of the ball from the point load applied to the ball in the region of contact between the distal end of the shoulder-defining body and the wall of the ball. It will also be appreciated that the resilient washer will be sufficiently flexible so as to readily deform in order to facilitate easy insertion of the resilient washer into the internal space of the ball via the hole in the ball.

The provision of the resilient washer and more particularly, the skirt 37 thereof, thus reduces point loading at the distal ends of the shoulder-defining bodies when the ball deforms around the ends of the shoulder-defining bodies when it is struck by a relatively heavy blow.

The cushioning of blows on the ball provided by the resilient washer also provides a ball to which the anchor fitting is fitted, with an improved impact feel and sound. In tests conducted on balls fitted with the anchor fitting disclosed in U.S. Pat. No. 7,252,607, the applicant noticed that the balls would produce a harsh impact feel upon being struck by a relatively heavy blow particularly when the ball is struck at a region of the ball where a shoulder-defining body abuts the interior side of the wall forming the ball. This problem is ameliorated by the provision of the resilient washer which absorbs and cushions the impact.

Figure 6:
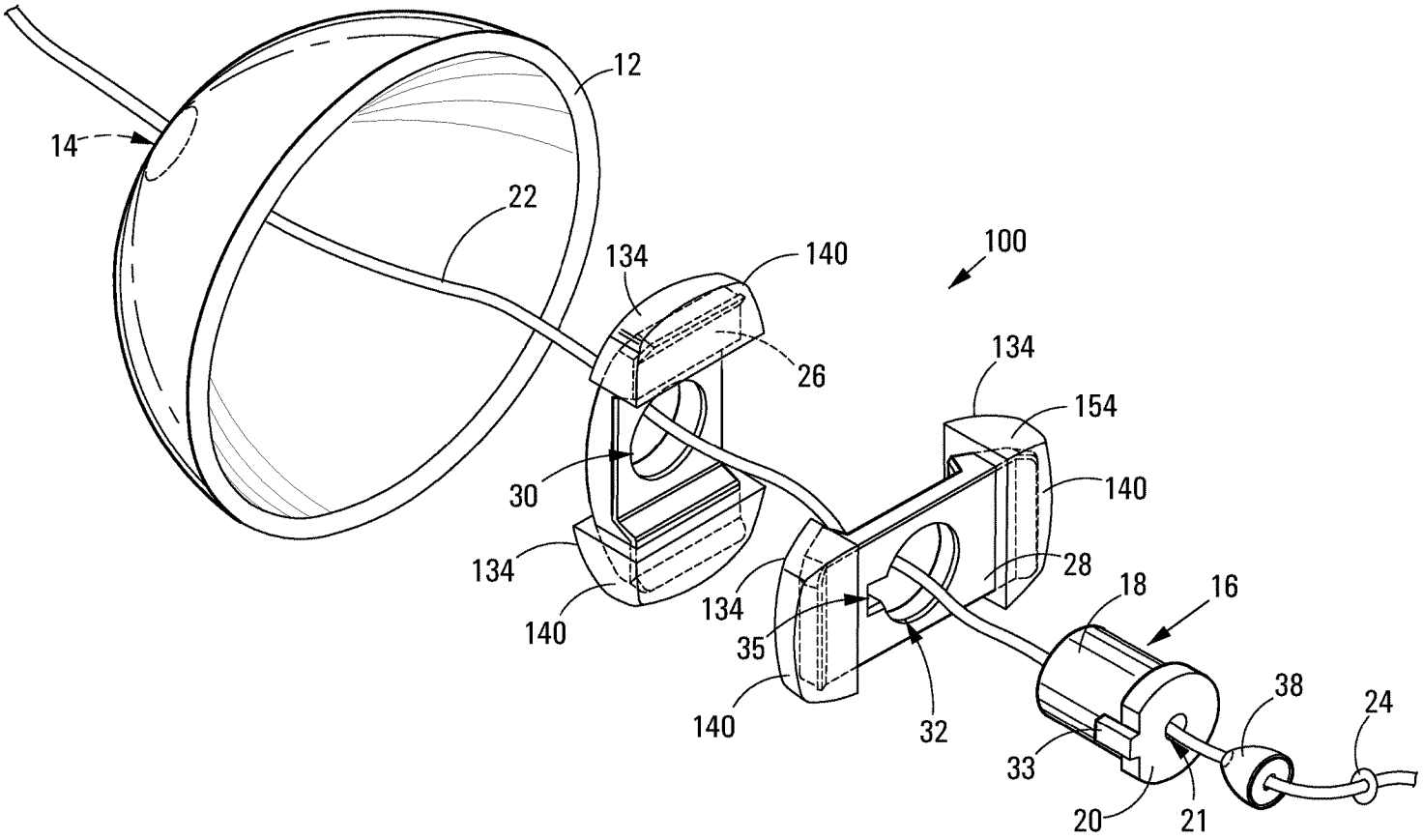
FIG. 6 shows a fragmentary exploded three-dimensional view of a second embodiment of an improved anchor fitting in accordance with the invention, for anchoring a flight control device in the form of a tether cord, to a ball.
Figure 7:
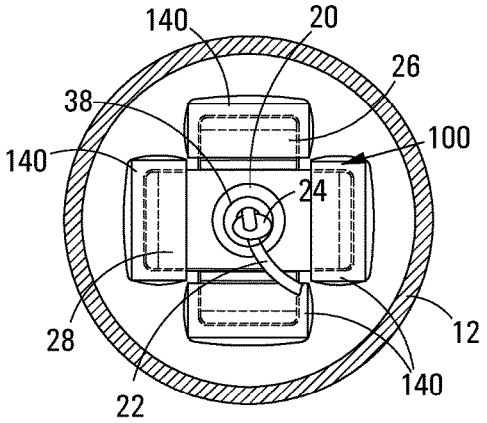
FIG. 7 shows a sectional rear end view of the anchor fitting as shown in FIG. 6, fitted to a ball.
Figure 8:
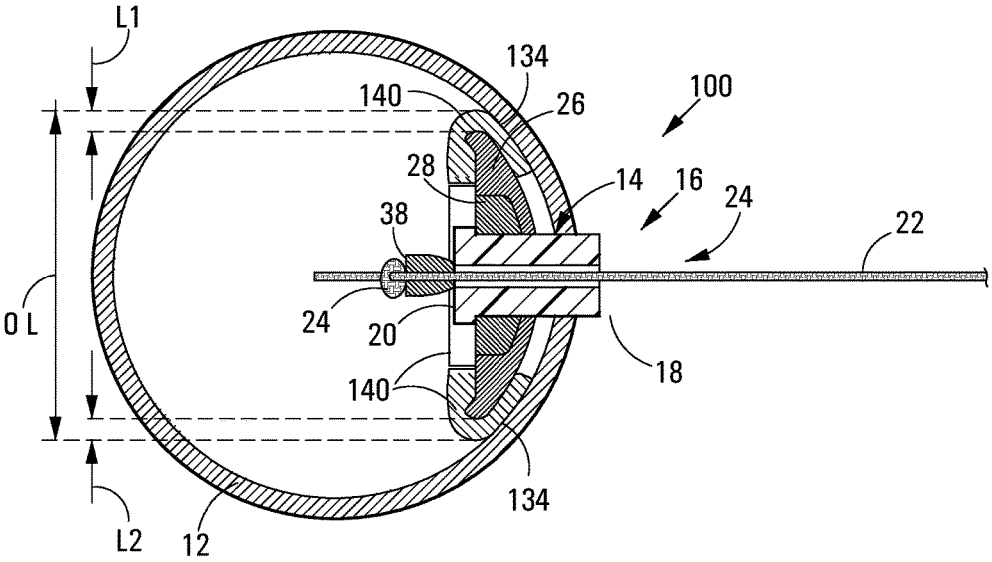
FIG. 8 shows a sectional side view of the assembled anchor fitting of FIG. 6 in its operative configuration with respect to a hollow ball.

With reference to FIGS. 6 to 8 of the drawings, a second embodiment of an improved anchor fitting in accordance with the invention for anchoring a tether cord to a ball, is designated by the reference numeral 100. The anchor fitting 100 is similar to the anchor fitting with the only difference being the configuration of the impact absorption formation. Instead of the resilient washer 34 of the anchor fitting 10, the anchor fitting 100 includes four locating bodies 140 which are each connected to the distal end of a different one of the shoulder-defining bodies 26 and 28. Each locating body has a wall portion defining a resilient pad 134 which is of rubber or any other suitable resilient material and which is located between the shoulder-defining body to which it is connected and an interior side of the wall 12 forming the ball. The locating bodies are entirely of rubber or any other suitable resilient material and are moulded to distal end regions of the shoulder-defining bodies. In FIGS. 6 to 8, the features of the anchor fitting 100 which are the same as and/or similar to the features of the anchor fitting 10, are designated by the same and/or similar reference numerals.

The resilient pads 134 of the anchor fitting 100 fulfil the same function as the resilient washer 34 of the anchor fitting 10 and are effective in absorbing shock loads applied to the ball when struck particularly near distal end regions of the shoulder-defining bodies. As for the resilient washer 34, the resilient pads 134 project beyond the distal ends of the shoulder-defining bodies, thereby extending the effective lengths of the shoulder-defining bodies and surface area of the assembled anchor fitting within the ball. In FIG. 8, the overall length of the shoulder-defining body 26 is designated by the reference numeral "OL", while it can be seen that projecting portions "L1" and "L2" at opposite ends of the resilient pads 134 extend the effective length of the shoulder-defining body 26.

Figure 9:
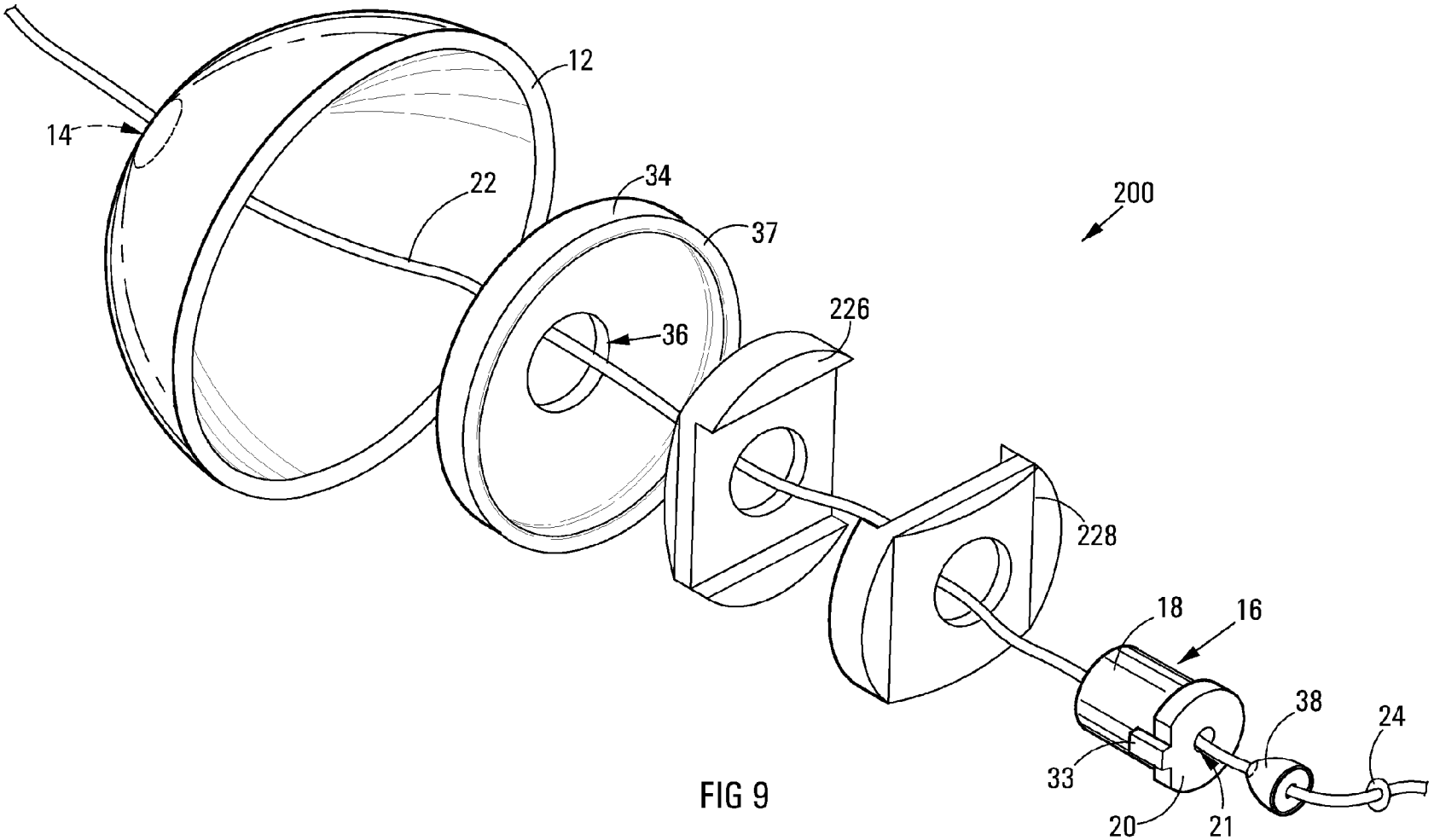
FIG. 9 shows a fragmentary exploded three-dimensional view of a third embodiment of an improved anchor fitting in accordance with the invention, for anchoring a flight control device in the form of a tether cord, to a ball.
Figure 10:
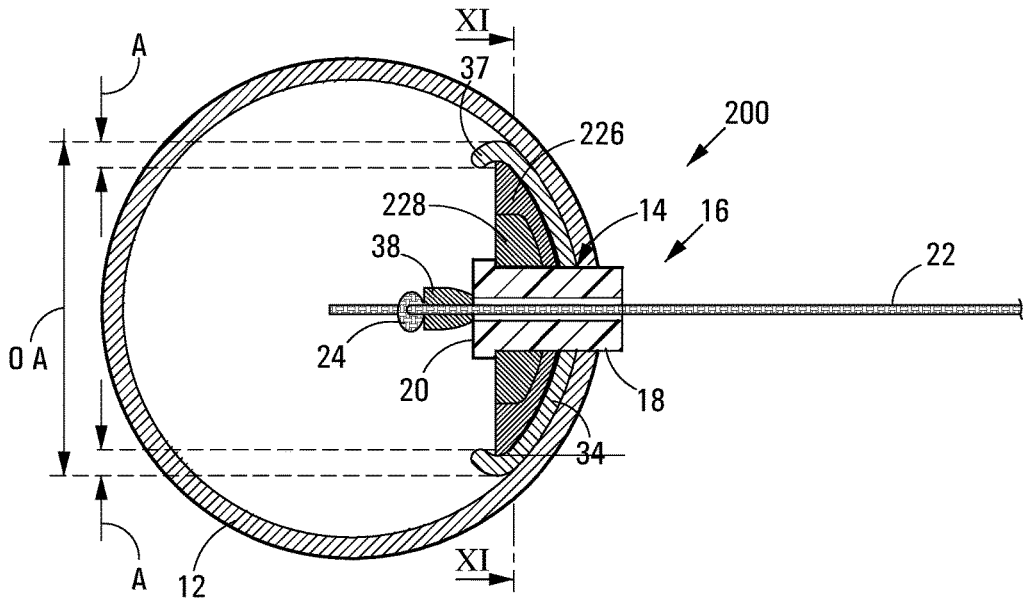
FIG. 10 shows a sectional side view of the assembled anchor fitting of FIG. 9 in its operative configuration with respect to a hollow ball.
Figure 11:
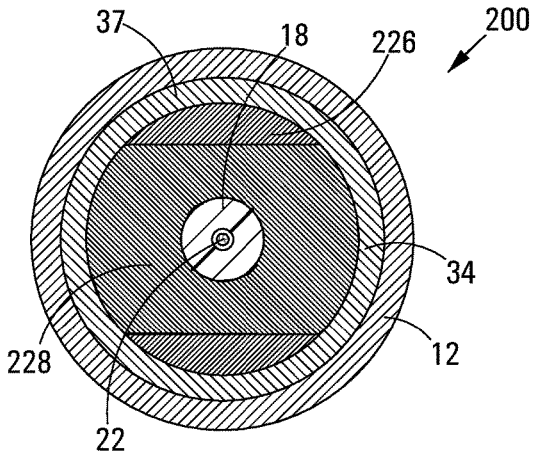
FIG. 11 shows a sectional end view of the assembled and/or fitting of FIG. 9, as sectioned along section line XI-XI of FIG. 10.

With reference to FIGS. 9 to 11 of the drawings, a third embodiment of an improved anchor fitting in accordance with the invention for anchoring a tether cord to a ball, is designated generally by the reference numeral 200. The anchor fitting 200 is similar to the anchor fitting 10, with the only difference being the configuration of the shoulder-defining bodies. The same and/or similar features of the anchor fittings 10 and 200 are designated by the same and/or similar reference numerals in the drawings.

The anchor fitting 200 includes two shoulder-defining bodies 226 and 228 which, in an assembled condition of the anchor fitting within a ball 12, have a circular peripheral edge profile. In the assembled condition of the anchor fitting, the skirt 37 of the resilient washer 34 circumscribes the circular peripheral edge of the assembled shoulder-defining bodies in a snug fit. The circular peripheral edge profile of the shoulder-defining bodies provides a continuous circular edge without any inflections which may result in an increase in point-loading in the region of any such inflection upon impact by a bat. It will be appreciated that point-loading will result in possible damage to the wall of the ball and provide an unsatisfactory impact feel and sound and is thus to be avoided as much as is possible.

Figure 12:
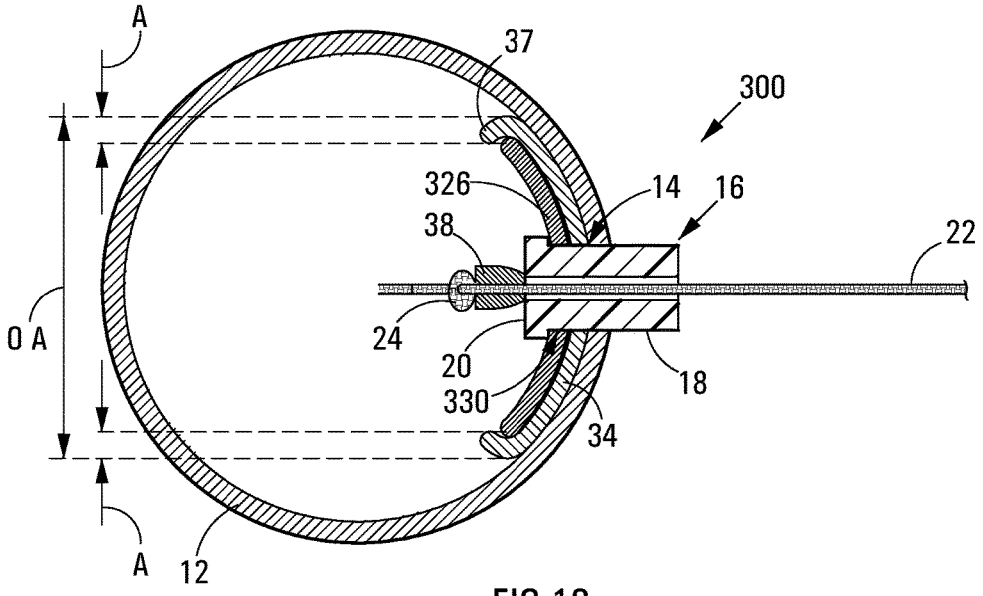
FIG. 12 shows a sectional side view of a fourth embodiment of an improved anchor fitting in accordance with the invention, fitted to a ball for anchoring a flight control device in the form of a tether cord, to the ball.
Figure 13:
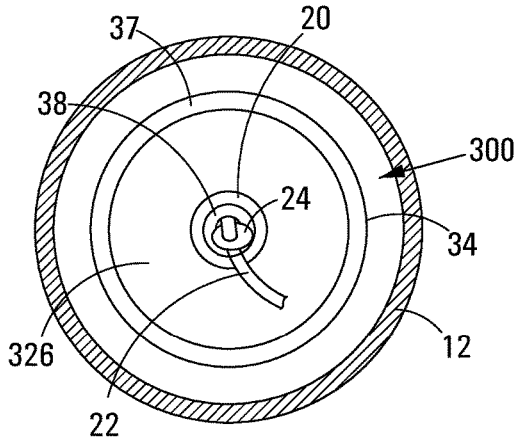
FIG. 13 shows a sectional rear end view of the anchor fitting of FIG. 12, fitted to the ball.

With reference to FIGS. 12 and 13 of the drawings, a fourth embodiment of an improved anchor fitting in accordance with the invention for anchoring a tether cord to a ball, is designated generally by the reference numeral 300. The anchor fitting 300 is similar to the anchor fitting 200. As such, features of the anchor fitting 300 which are the same as and/or similar to those of the anchor fitting 200 are designated by the same and/or similar reference numerals in FIGS. 12 and 13. The anchor fitting 300 includes the anchor body 16, the freely rotatable bearing body 38 and the flexible resilient washer 34. Instead of the two shoulder-defining bodies 226 and 228, the anchor fitting 300 includes a single rigid, disc-shaped shoulder-defining body 326 defining a central aperture 330 within which the shank 18 of the anchor body 16 is slidably received. More specifically, in the assembled condition of the anchor fitting 300, the resilient washer 34 is located between and abuts the shoulder-defining body 326 at one side and an inner side of the wall of the ball 12 at an opposite side thereof. As such, the shoulder-defining body 326 and the resilient washer 34 have complementary curved abutment faces which abut one another in the assembled condition of the anchor fitting within the ball 12.

Figure 14:
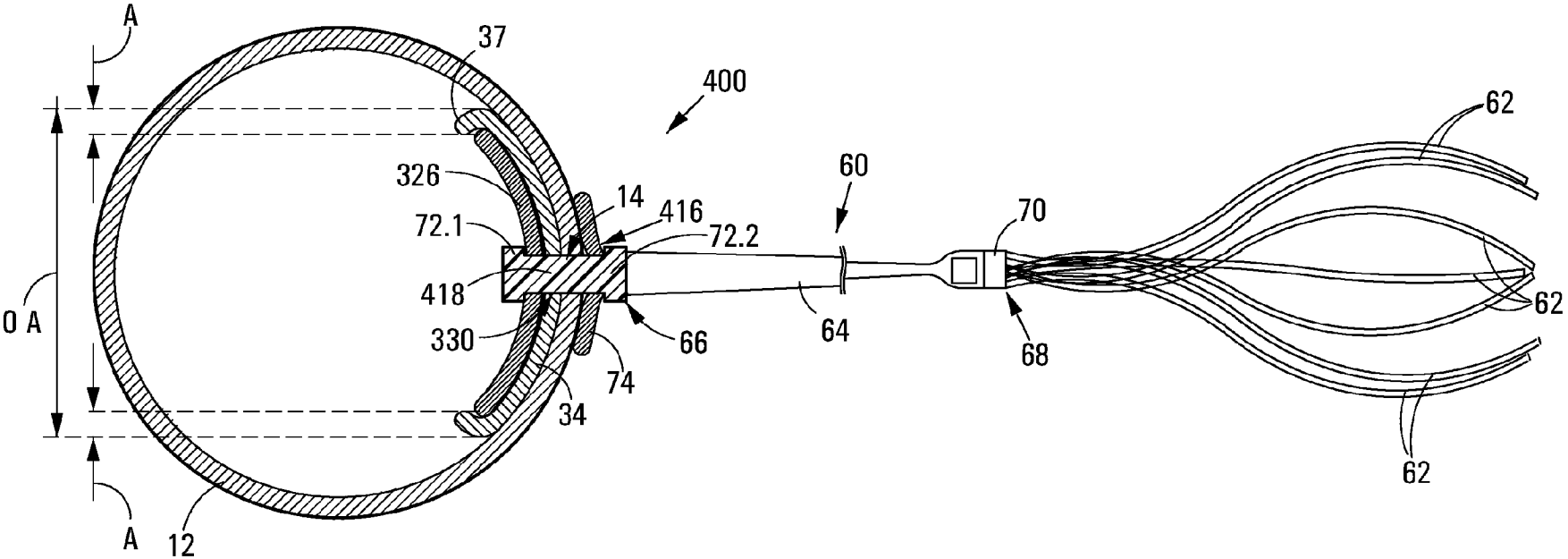
FIG. 14 shows a sectional side view of a fifth embodiment of an improved anchor fitting in accordance with the invention fitted to a ball, for anchoring a flight control device in the form of a tail, to the ball.

With reference to FIG. 14 of the drawings, a fifth embodiment of an improved anchor fitting in accordance with the invention for anchoring a tail to a ball, is designated generally by the reference numeral 400. The anchor fitting 400 is similar to the anchor fitting 300 and as such, features of the anchor fitting 400 which are the same as and/or similar to those of the anchor fitting 300 are designated by the same and/or similar reference numerals in FIG. 14.

The anchor fitting 400 is configured for anchoring a flight control device in the form of a tail 60 to the ball 12. The tail 60 comprises one or more elongate thin flexible streamers 62 and an elongate resiliently flexible spacer stem 64. The spacer stem 64 has a proximal end 66 which is attached to the wall of the ball and a distal end 68 having an attachment formation 70 providing for attachment of the streamers to the spacer stem.

The anchor fitting includes the flexible resilient washer 34 and the single rigid disc-shaped shoulder-defining body 326 and further includes an anchor body 416 which is integrally formed with the spacer stem at its proximal end. More specifically, the anchor body 416 comprises an elongate shank portion 418 which operatively extends through the hole 14 in the ball. The shank portion has a pair of flanges 72.1 and 72.2 at opposite ends thereof. More specifically, the flange 72.1 is disposed at an inner end of the shank portion and abuts an inner side of the shoulder-defining body 326, while the flange 72.2 is disposed at an outer end of the shank portion externally of the ball in the assembled condition of the anchor fitting. The anchor fitting includes a resilient retaining washer 74 which is located between an external side of the ball and the flange 72.2 in a tensioned state, thereby limiting axial displacement of the shank portion within the hole 14.

Figure 15:
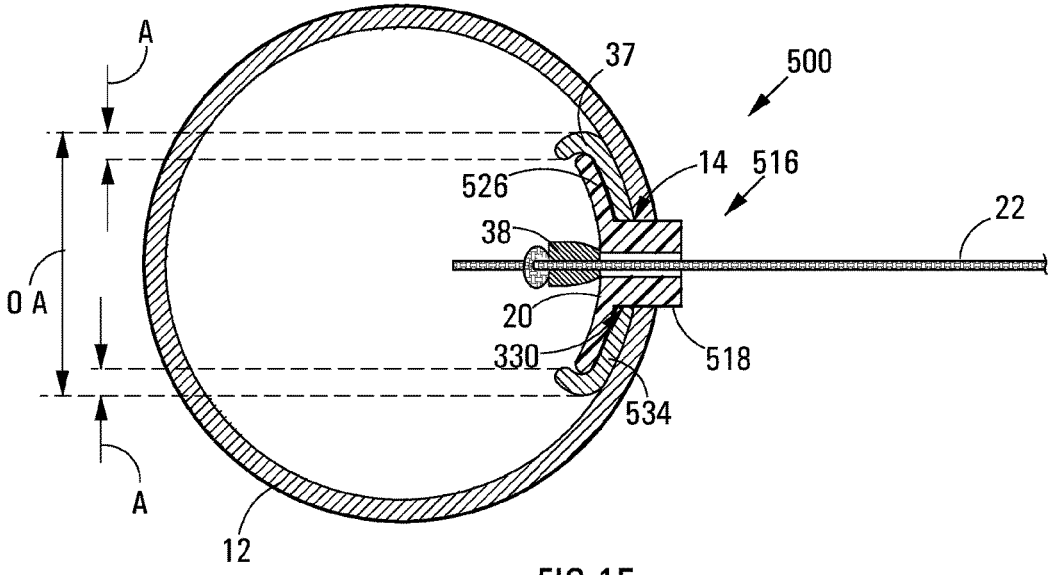
FIG. 15 shows a sectional side view of a sixth embodiment of an improved anchor fitting in accordance with the invention fitted to a ball, for anchoring a flight control device in the form of a tether cord, to the ball.

With reference to FIG. 15 of the drawings, a sixth embodiment of an improved anchor fitting in accordance with the invention for anchoring a tether cord to a ball, is designated generally by the reference numeral 500. The anchor fitting 500 is similar to the anchor fitting 300, with the only difference being that the shoulder-defining body is formed integrally with the anchor body so as to form a combined anchor body and shoulder-defining body having a unitary structure. As such, features of the anchor fitting 500 which are the same as and/or similar to those of the anchor fitting 300 are designated by the same and/or similar reference numerals in FIG. 15. As can be seen in FIG. 15, the improved anchor fitting 500 includes an anchor body part 516 and a rigid, disc-shaped shoulder-defining body part 526 integrally formed therewith. The shoulder-defining body part 526 and the resilient washer 534 have complementary curved abutment faces which abut one another in the assembled condition of the anchor fitting within the ball 12. The shoulder-defining body part 526 has relatively smaller dimensions when viewed in plan view, than corresponding dimensions of the shoulder-defining body 326. As a result, the smaller size of the shoulder-defining body part 526 facilitates the insertion of the shoulder-defining body part together with the integrally formed anchor body part 516, into the ball through the hole 14 in the wall of the ball. It will be appreciated that due to the smaller size of the shoulder-defining body part 526, the resilient washer 534 is smaller than the resilient washer 34 of the anchor fitting 300, when viewed in plan view.

Figure 16:
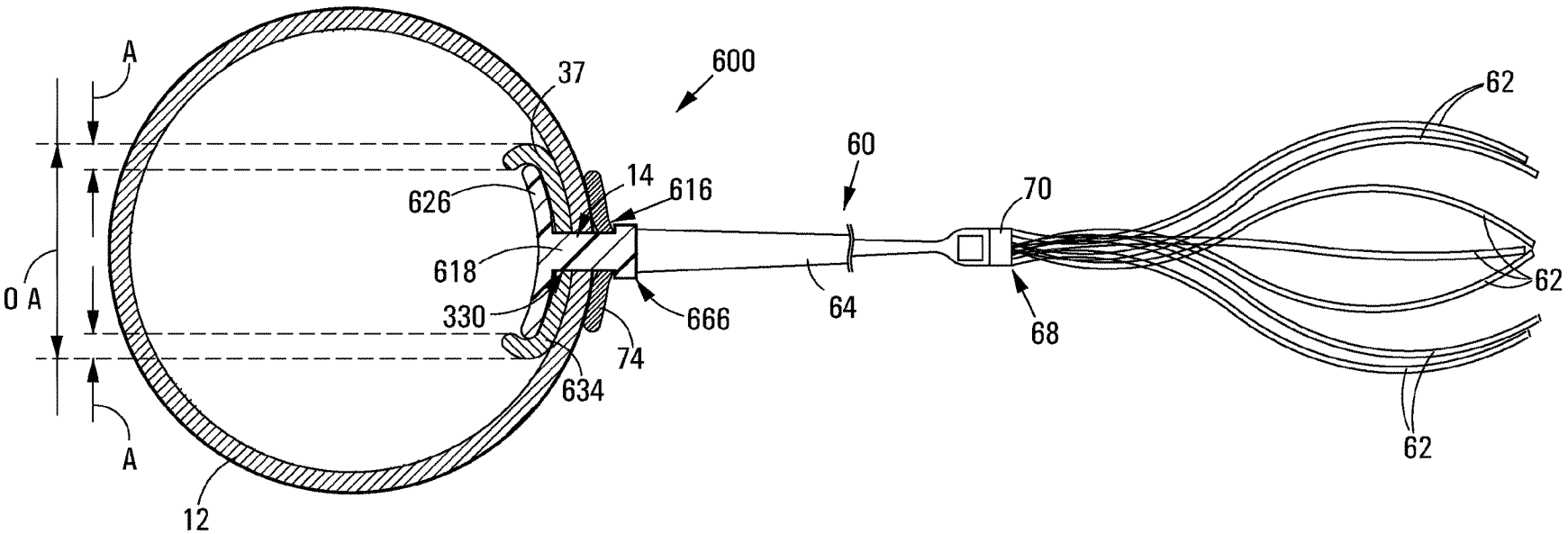
FIG. 16 shows a sectional side view of a seventh embodiment of an improved anchor fitting in accordance with the invention fitted to a ball, for anchoring a flight control device in the form of a tail, to the ball.

With reference to FIG. 16 of the drawings, a seventh embodiment of an improved anchor fitting in accordance with the invention for anchoring a tail to a ball, is designated generally by the reference numeral 600. The anchor fitting 600 is similar to the anchor fitting 400, with the only difference being that the anchor body and the shoulder-defining body are formed integrally so as to form a combined anchor body and shoulder-defining body having a unitary structure. As such, features of the anchor fitting 600 which are the same as and/or similar to those of the anchor fitting 400, are designated by the same and/or similar reference numerals in FIG. 16. As can be seen in FIG. 16, the improved anchor fitting 600 includes an anchor body part 626 and a rigid shoulder-defining body part 626 integrally formed therewith. The shoulder-defining body part 626 and the resilient washer 634 have complementary abutment faces which abut one another in the assembled condition of the anchor fitting within the ball 12. The shoulder-defining body part 626 has relatively smaller dimensions when viewed in plan view, than corresponding dimensions of the shoulder-defining body 326. As a result, the smaller size of the shoulder-defining body part 626 facilitates the insertion of the shoulder-defining body part together with the integrally formed anchor body part 616 into the ball through the hole 14 in the wall of the ball. It will be appreciated that due to the smaller size of the shoulder-defining body part 626, the resilient washer 634 is smaller than the resilient washer 34 of the anchor fitting 400, when viewed in plan view.

The invention extends to the ball 14 having the improved anchor fitting 10, 100, 200, 300, 400, 500 or 600 as part thereof.

The Applicant has found that the improved anchor fitting for anchoring a tether cord to a hollow ball, in accordance with the invention, is particularly advantageous when used for anchoring a tether cord to a hollow ball having a wall thickness of less than 3.5 mm (the wall thickness of a standard tennis ball). Such relatively thin-walled balls for tether tennis games tend to be lighter and therefore enable the use of relatively lighter bats and also offer an improved feel and performance when struck by a bat. Such lighter bats, besides being less expensive to produce, also have the advantage of being easier to handle by children.

The Applicant has found that the use of existing known anchor fittings, including the anchor fitting disclosed in U.S. Pat. No. 7,252,607 with such thin-walled balls, did not work as the ball soon split in the region of the hole through which the anchor fitting projects, after being struck by the bat. The anchor fitting disclosed in U.S. Pat. No. 7,252,607, for example, is typically used with standard tennis balls having a 3.5 mm wall thickness and a 9 mm diameter hole in which the anchor fitting is located. In tests conducted by the Applicant with this anchor fitting to overcome the above-mentioned problem, the diameter of the hole of the ball was increased to 12 mm thereby to lengthen the circumference of the portion of the wall of the ball defining the hole so as to compensate for the decrease in wall thickness of the ball. Increasing the ball hole diameter thus increases the surface area of the wall defining the hole, which is in contact with the part of the anchor fitting which is located in the hole and thus reduces impact loads per square centimeter acting on the ball when it is struck by a bat.

In further tests conducted by the Applicant, it was found that increasing the diameter of the ball hole improved the situation but resulted in an increased propensity of the anchor fitting to pull completely out of the ball through the hole without the ball splitting, especially when struck by a relatively hard blow with a bat. It became apparent that this was caused by the propensity of a relatively larger ball hole, combined with a thinner ball wall thickness which stretches open more readily, to permit the anchor fitting to be pulled out through the hole. In order to address this problem the Applicant then redesigned the shoulder-defining bodies so as to extend the lengths thereof but it soon became apparent that this caused further problems as the increased length of the shoulder-defining bodies meant that the shoulder-defining bodies protruded even further into the impact zone of the ball thereby producing a harsh impact feel. Furthermore, the spacing between the distal ends of the shoulder-defining bodies becomes increasingly larger with increasing length of the shoulder-defining bodies which effectively means that distal end regions of the shoulder-defining bodies are more isolated and therefore subjected to greater point loading. When the ball is struck, the increased spacing between the distal end regions of longer shoulder-defining bodies means that impacts to the ball will be borne by the shoulder-defining body in the region of the impact only resulting in undesirable point loading at the impact location. In the case of relatively shorter shoulder-defining bodies, the impact forces may be distributed across two adjacent shoulder-defining bodies due to their proximity. For the above mentioned reasons, it is desirable for the lengths of the rigid shoulder-defining bodies to be relatively short.

The use of impact absorption formations which extend beyond the rigid shoulder-defining bodies, permit the use of relatively shorter rigid shoulder-defining bodies than would be the case if there were no such impact absorption formations. The use of such relatively shorter rigid shoulder-defining bodies and impact absorption formations which extend beyond distal ends of the shoulder-defining bodies, reduces unpleasant impact jarring as the rigid shoulder-defining bodies do not protrude as far into the impact zone which is particularly sensitive in the case where the impact zone has a relatively thin wall thickness.

The designs of the improved anchor fittings 10, 100, 200, 300, 400, 500 and 600 have satisfactorily overcome the problems associated with the anchoring of a tether cord to such relatively thin-walled hollow balls. The resilient washer 34 of the anchor fittings 10, 100, 200, 300 and 400 and the resilient pads 134 of the anchor fitting 100 permit the use of relatively shorter length rigid shoulder-defining bodies while providing for the effective lengths of the rigid shoulder-defining bodies to be extended sufficiently by the projecting peripheral regions of the relevant resilient washer 34 or resilient pads 134, so as to resist being pulled out through the hole in a ball within which the anchor fitting is fitted.

The invention claimed is:

1. An anchor fitting for anchoring a flight control device to a hollow ball which includes, in an operative configuration with respect to the ball, an anchor body of a substantially rigid material which is attached to the flight control device and which defines an elongate shank portion operatively extending through a hole in the ball;

at least one substantially rigid shoulder-defining body which is located within the ball and which extends radially outwardly with respect to the anchor body, the at least one shoulder-defining body defining a curved abutment segment having a curved face having a curvature that conforms to the curvature of an interior side of the wall of the ball; and at least one resiliently deformable impact absorption formation located between the at least one shoulder-defining body and an interior side of a wall forming the ball, the impact absorption formation having a curved profile which conforms to the curvature of the interior side of the wall of the ball, the impact absorption formation being configured to extend beyond and cover distal end regions of the shoulder-defining body, the at least one shoulder-defining body abutting an inner side of the impact absorption formation in the operative configuration of the anchor fitting.

2. The anchor fitting as claimed in claim 1, wherein the at least one shoulder-defining body defines a hole therethrough which is operatively positioned in register with the hole in the ball, the shank portion of the anchor body operatively extending through the holes in the at least one shoulder-defining body and the ball and defining an enlarged head which bears against a side of the at least one shoulder-defining body remote from the side thereof which abuts the impact absorption formation, thereby holding the at least one shoulder-defining body against the impact absorption formation.

3. The anchor fitting as claimed in claim 2, wherein the impact absorption formation is in the form of a resilient washer which, in the operative configuration of the anchor fitting with respect to the ball, is located between the at least one shoulder-defining body and an interior side of the wall forming the ball, the resilient washer defining a central hole which is operatively in register with the hole in the ball and the hole in the at least one shoulder-defining body, the resilient washer projecting beyond distal ends of the at least one shoulder-defining body.

4. The anchor fitting as claimed in claim 3, wherein the resilient washer has a circumferential skirt which circumscribes and covers a distal end region of the at least one shoulder-defining body in an assembled condition of the anchor fitting within a ball.

5. The anchor fitting as claimed in claim 3, wherein the anchor fitting includes one shoulder-defining body which is disc-shaped when viewed in plan view.

6. The anchor fitting as claimed in claim 5, wherein the resilient washer has a disc-shaped configuration which is complementary to the disc-shape of the shoulder-defining body when viewed in plan view.

7. The anchor fitting as claimed in claim 1, wherein the at least one shoulder-defining body is formed integrally with the anchor body so as to form a combined anchor body and shoulder-defining body having a unitary structure.

8. The anchor fitting as claimed in claim 1, wherein the at least one shoulder-defining body has an elongate configuration.

9. The anchor fitting as claimed in claim 8, which includes a pair of impact absorption formations wherein each impact absorption formation is in the form of a resilient pad wherein each pad is connected to a different distal end region of the at least one shoulder-defining body so as to be located between the interior side of the wall forming the ball and the distal end region of the shoulder-defining body in an arrangement wherein each pad extends beyond the distal end of the associated shoulder-defining body.

10. The anchor fitting as claimed in claim 9, wherein each impact absorption formation comprises a locating body defining one of the resilient pads, the locating body further defining a socket within which an end region of the at least one shoulder-defining body is received.

11. The anchor fitting as claimed in claim 10, wherein the locating body is moulded to a particular one of the distal end regions of the at least one shoulder-defining body.

12. The anchor fitting as claimed in claim 1, which includes two shoulder-defining bodies which each have an elongate configuration and which, when operatively positioned with their respective holes in register with the hole in the ball, extend substantially perpendicularly with respect to one another.

13. The anchor fitting as claimed in claim 12, wherein the shoulder-defining bodies define complementary locating formations that serve to locate the shoulder-defining bodies with respect to one another during assembly of the anchor fitting with the aid of the tether cord.

14. The anchor fitting as claimed in claim 12, which includes four impact absorption formations in the form of resilient pads wherein each pad is connected to a different end region of the shoulder-defining bodies so as to be located between the interior side of the wall forming the ball and the distal end region of the shoulder-defining body associated therewith, in an arrangement wherein each pad extends beyond the distal end of the associated shoulder-defining body.

15. The anchor fitting as claimed in claim 12, wherein the two shoulder-defining bodies together define a circular peripheral edge profile when viewed in plan view, in an assembled condition of the anchor fitting within the ball.

16. The anchor fitting as claimed in claim 15, wherein the impact absorption formation is in the form of a resilient washer which, in the operative configuration of the anchor fitting with respect to the ball, is located between the shoulder defining bodies and an interior side of the wall forming the ball in an assembled condition of the anchor fitting within the ball, the resilient washer defining a central hole which is operatively in register with the hole in the ball and the holes in the shoulder-defining bodies, the resilient washer projecting beyond distal ends of the shoulder-defining bodies.

17. The anchor fitting as claimed in claim 1, wherein the anchor fitting is configured for anchoring a flight control device in the form of a tether cord to the ball, the anchor body defining an axial passage therethrough which extends through the elongate shank portion and the head, the axial passage permitting a tether cord having a stop formation at an end of the cord within the ball, to extend therethrough into the ball, the anchor fitting including a bearing body operatively located between the stop formation at the end of the tether cord and the head of anchor body, to operatively bear against the head of the anchor body and rotate relative to the head, in use, thereby to permit free rotation of the tether cord within the axial passage defined through the elongate shank portion and the head of the anchor body.

18. The anchor fitting as claimed in claim 1, wherein the anchor fitting is configured for anchoring a flight control device in the form of a tail to the ball.

19. The anchor fitting as claimed in claim 18, wherein the tail comprises a spacer stem having a proximal end which is integrally formed with the anchor body of the anchor fitting and a distal end and at least one flexible streamer which is attached to the distal end of the spacer stem.

20. A hollow ball including the anchor fitting as claimed in claim 1.

* * * * *